United States Patent [19]

Gooding

[11] 4,445,358

[45] May 1, 1984

[54] PORTABLE TOOL FOR AFFIXING TERMINALS ONTO BATTERY CABLES

[75] Inventor: Robert J. Gooding, Chester Springs, Pa.

[73] Assignee: Action Concepts, Inc., Chester Springs, Pa.

[21] Appl. No.: 402,099

[22] Filed: Jul. 26, 1982

[51] Int. Cl.[3] ..... B21D 37/10

[52] U.S. Cl. ..... 72/416; 29/751; 72/454

[58] Field of Search ..... 72/416, 414, 454, 409, 72/410, 470; 29/751

[56] References Cited

U.S. PATENT DOCUMENTS

| | | | |
|---|---|---|---|
| 3,057,233 | 10/1962 | Turner | 72/416 |
| 3,146,519 | 9/1964 | Redwine | 72/416 |
| 3,172,454 | 3/1965 | Wilson | 72/454 |
| 3,577,622 | 5/1971 | Shaffer | 29/751 |
| 4,043,174 | 8/1977 | Paolino | 29/751 |
| 4,140,001 | 2/1979 | Moulton | 72/416 |
| 4,365,501 | 12/1982 | Potts | 72/416 |
| 4,385,515 | 5/1983 | Link | 72/416 |

FOREIGN PATENT DOCUMENTS

| | | | |
|---|---|---|---|
| 1280796 | 9/1966 | Fed. Rep. of Germany | 72/454 |
| 243637 | 1/1947 | Switzerland | 72/454 |

*Primary Examiner*—Gene P. Crosby

*Attorney, Agent, or Firm*—Charles A. McClure

[57] ABSTRACT

A portable swaging tool for affixing, onto the end of an electrical cable, a terminal of the type that fits on the terminal post of an electrical storage battery such as may be used to drive the starting motor of an internal combustion engine. A handle carrying one of a pair of cooperating jaws has pivoted to it a clamping member carrying the other cooperating jaw so as to be juxtaposed to the first jaw when the free end of the clamping member is swung to and against the handle. The handle also carries clamping screw means for forcing the clamping member against the handle to clamp a terminal pre-inserted between the jaws and to swage the terminal tightly onto the end of a battery cable pre-inserted into a bore in the terminal.

9 Claims, 7 Drawing Figures

PORTABLE TOOL FOR AFFIXING TERMINALS ONTO BATTERY CABLES

This invention relates to a portable swaging tool for affixing a terminal onto an electrical cable suitable for conducting substantial currents, as from an electrical storage battery to operate the starting motor for an internal combustion engine.

Affixing of a replacement terminal onto a battery cable, from which—usually through corrosion—a terminal has separated or is about to separate, usually is accomplished (or, at least, is attempted) by means of a long-handled tool similar to the familiar bolt-cutter but having its jaws suited to deforming the terminal rather than cutting or shearing it. However, adequate access to the end of the cable to locate such a tool properly, especially in the open position, often is impossible without detaching the cable—at sometimes nearly inaccessible bracket or clamp locations. Attempts to meet the need for a smaller device to accomplish this important purpose have proved otherwise inconvenient, by requiring excessive assembly or manipulation, as in Shaffer U.S. Pat. No. 3,577,622. Tools for crimping terminals onto wires for carrying fractional ampere currents, as in Paolino U.S. Pat. No. 4,043,174, are incapable of coping with the demands imposed by the need for a cable-terminal combination capable of conducting currents of dozens or hundreds of amperes.

A primary object of the present invention is provision of a portable tool for swaging terminals onto electrical cables for use with electrical storage batteries of high current capacity.

Another object of this invention is such a tool to which enough clamping force to swage a terminal onto the cable may be applied either manually with a wrench or by rotary drive means.

A further object is provision of such a tool adapted for use on terminals of different sizes and current-carrying ratings.

Other objects of the invention, together with means and methods for attaining the various objects, will be apparent from the following description and the accompanying diagrams of a preferred embodiment, which is presented by way of example rather than limitation.

FIG. 7 shows one such jaw edge-on.

In general, the objects of the present invention are accomplished, in a portable tool for swaging a battery cable terminal onto a battery cable, by means of a handle member and a clamping member, together carrying a pair of cooperating jaws adapted to receive a cable terminal therebetween and to clamp thereonto with sufficient force to swage the terminal onto and thereby affix it to a battery cable. The clamping member is carried pivotally at one end of the handle and is adapted thereby to be swung against the handle to juxtapose the respective jaws to one another and to be swung away therefrom to separate them. The handle also carries clamping screw means adapted to engage the free end of the clamping member and to force it against the handle sufficiently to swage a battery terminal pre-inserted between the jaws and thereby affix it onto a battery cable pre-inserted into a bore in the terminal.

Figure 1:
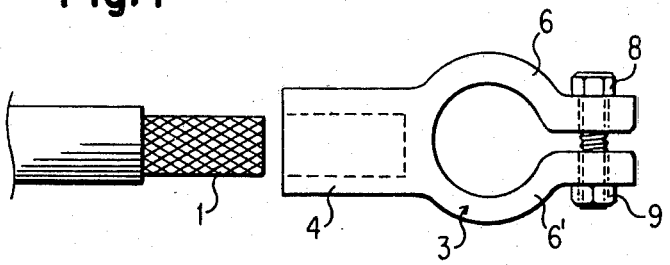
FIG. 1 shows in side elevation an electrical cable and a terminal suitable for attachment together according to this invention.

FIG. 1 shows from the side an end portion of electrical cable 1 and unattached terminal 3 adapted to be affixed onto it. The terminal has blind bore 4 in its cylindrical base portion 5 and has pair of arcuately curved arms 6,6' bored through their free ends. Bolt 8 with nut 9 on its end ties the ends together. A simpler form of terminal, with a circular opening in a flat end, instead of the split arms and the bolt and nut, would be similarly useful, of course, if bored likewise or otherwise similarly open and thereby adapted to receive the cable end.

Figure 2:
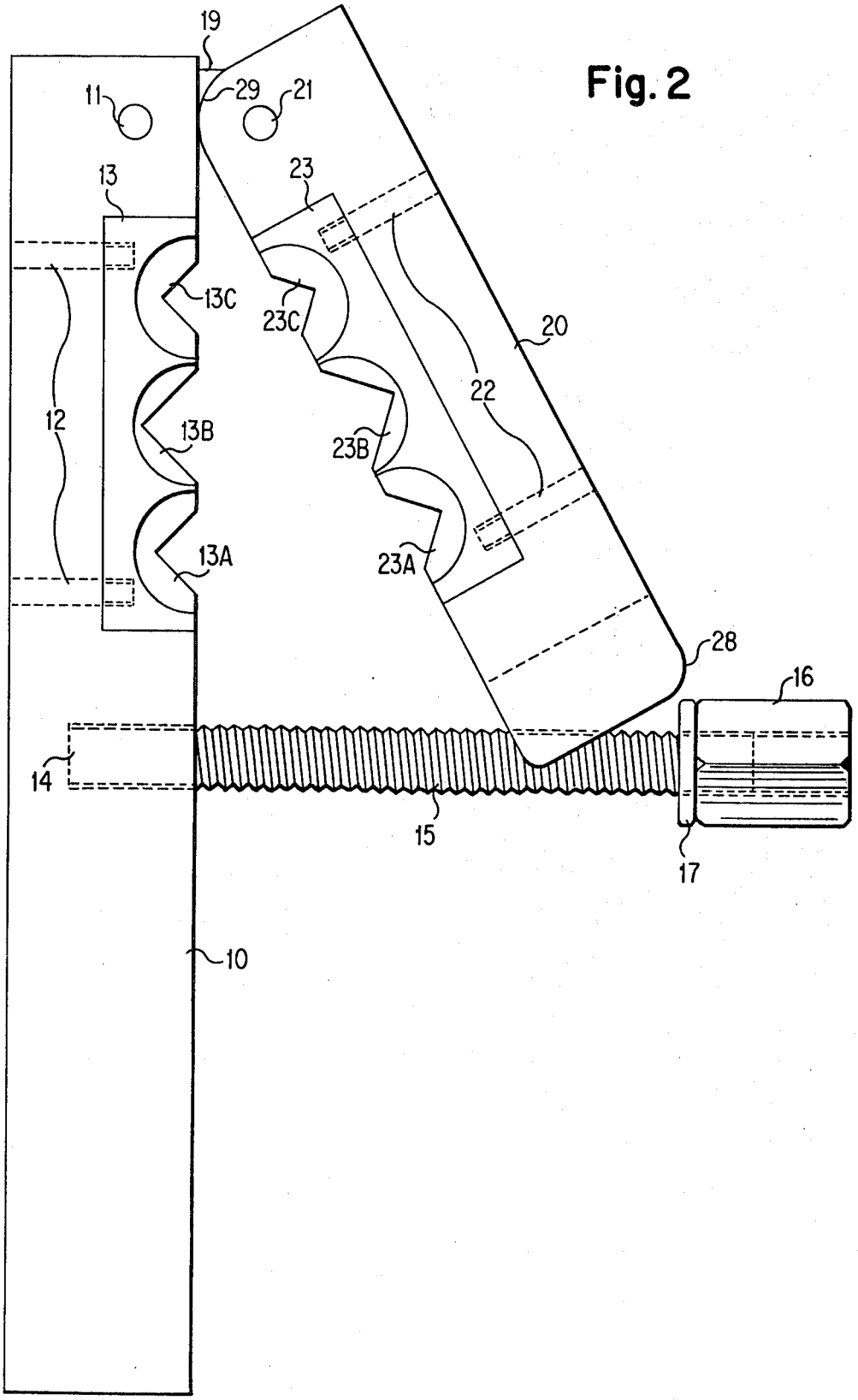
FIG. 2 shows in side elevation a tool according to this invention in open or unclamped position.

FIG. 2 shows, also from the side, handle member 10 and clamping member 20 in the open or unclamped position. They are secured together by tiepiece 19 (fragmentarily visible in this view). Pin 11 affixes the tiepiece to one end of the handle, and pin 21 pivotally retains one end of the clamping member to the tiepiece. Adjacent corner 29 of the clamping member end is rounded off to enable the clamping member to swing on the pivot pin without binding against the handle. Free end 24 of the clamping member has slot 25 therein to receive stud 15 as the clamping member is swung toward the closed position. The stud is secured at one end in bore 14 in the handle, and it carries nut 16 and washer 17 adapted to bear against the bifurcated slot-defining end portion of the clamping member. Rotation of the nut further onto the stud tends to close the clamping member onto the handle, whereas opposite rotation enebles it to unclamp or open. As shown, the stud is long enough that rounded corner 28 of the clamping member swings clear of the free end of the nut and washer which are backed off to a position near the free end of the stud.

Figure 3:
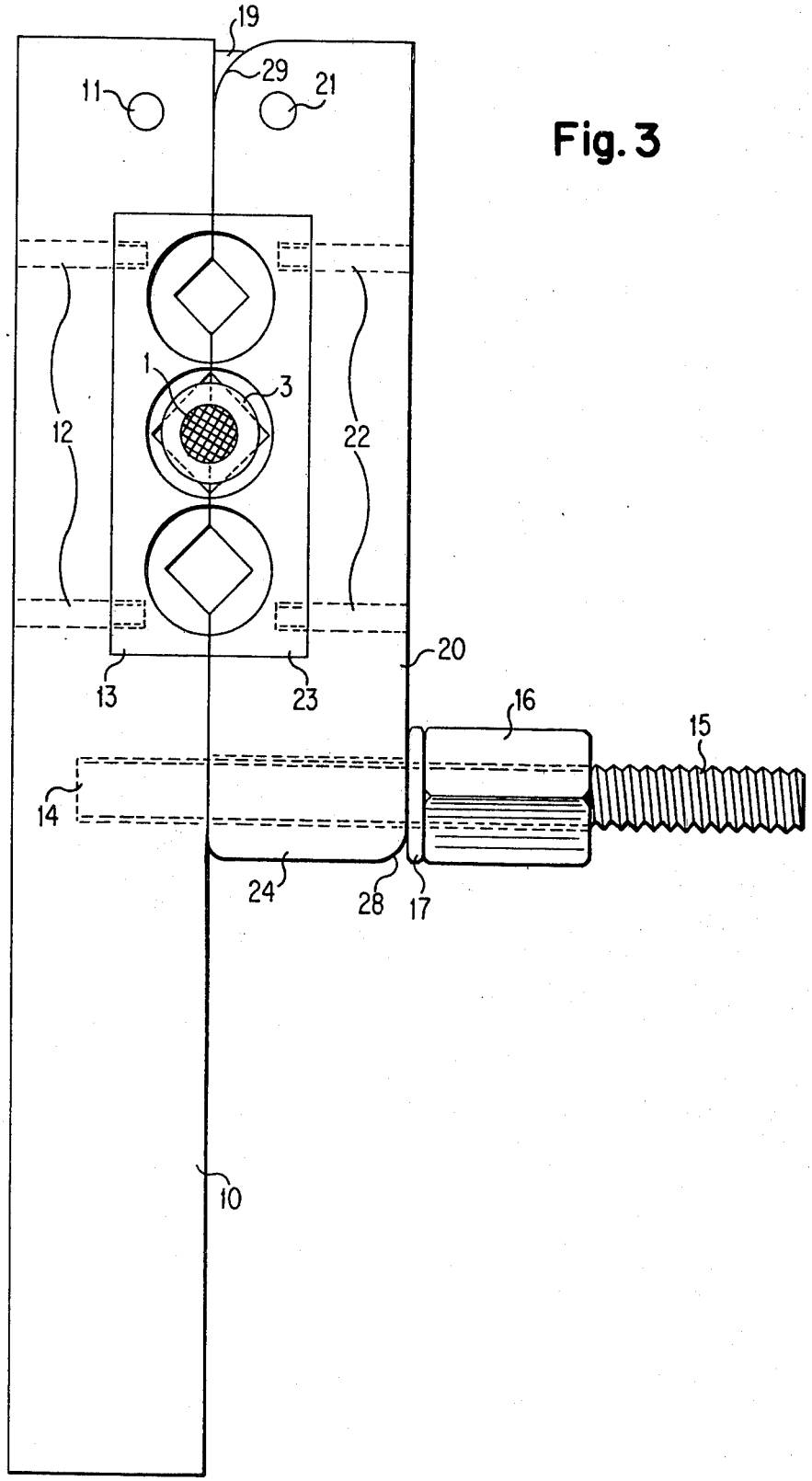
FIG. 3 shows in like manner the same tool in closed or clamped position and with a terminal and a cable (sectioned) in place therein.
Figure 4:
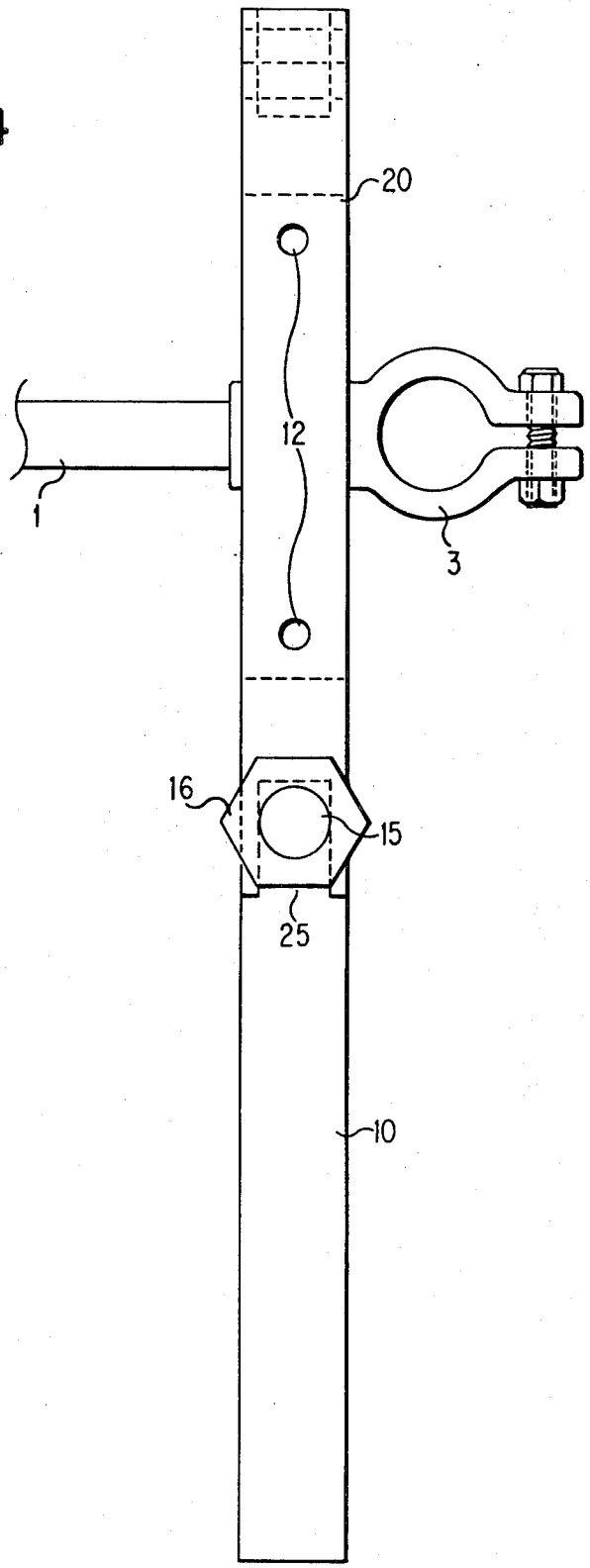
FIG. 4 shows the FIG. 3 arrangement edge-on from the front or opening direction.

FIGS. 3 and 4 show, from the side and front, respectively, the tool of FIG. 2 clamped onto the base of terminal 3 of FIG. 1, with the end of cable 1 inserted into the terminal bore and shown sectioned in FIG. 3 and broken away in FIG. 4. Clamping nut 16 is shown screwed sufficiently down onto stud 15 to force clamping member 20 against handle 10 and thereby swage the terminal base tightly onto the cable end. As noted, this may be accomplished by using a wrench on the nut or by applying to it a rotary drive tool such as is often used to screw an automobile wheel nut onto or off of its stud.

Figure 5:
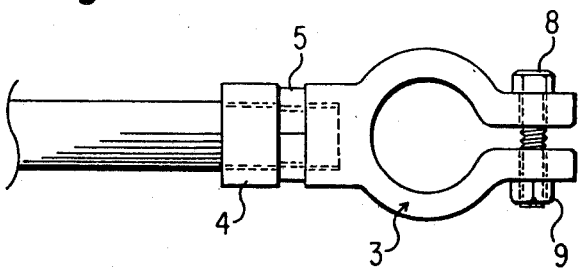
FIG. 5 shows in side elevation the resulting assembly of terminal and electrical cable with the tool removed.

FIG. 5 shows terminal 3 affixed onto the end of cable 1 by the portable swaging tool of this invention as just described. The formerly smooth cylindrical base of terminal 3 now has indentation 5 (with square transverse cross-section) where cooperating jaws 13 and 23 have swaged the metal (e.g., lead) of the base.

Figure 6:
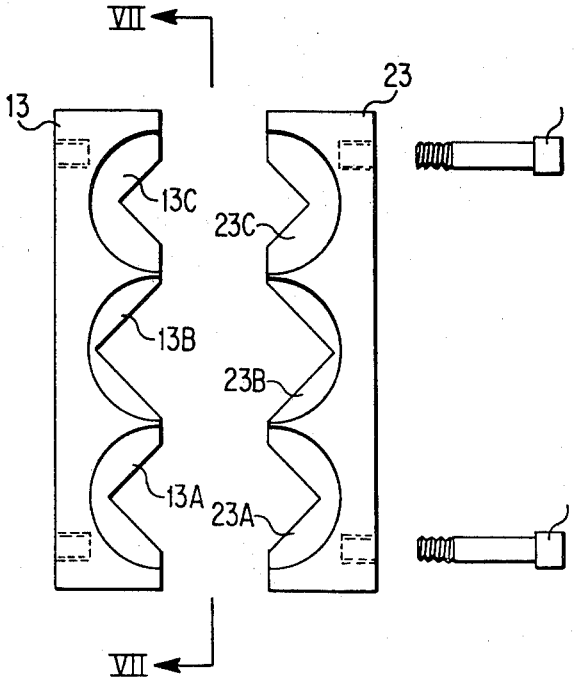
FIG. 6 shows in side elevation a pair of jaws insertable into and removable from the handle and clamping member.
Figure 7:
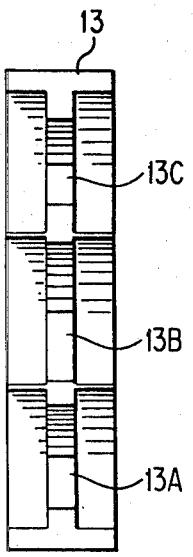

FIG. 6 shows from the side matched pair of jaws 13, 23 apart from the rest of the tool of this invention—specifically, its handle and clamping members. For versatility the jaws of this tool include several matched sizes of toothed swaging surfaces: 13A, 23A; 13B, 23B; and 13C, 23C. The two jaws are retained in their respective members by pairs of screws in bores 12 and 22 shown in one or more of the previous views. The jaws are readily removed for maintenance or replacement by simply loosening the retaining screws. FIG. 7 shows edge-on the swaging surfaces of jaw 13, being (like jaw 23) relieved on each side to be narrower than the full width of the supporting member—into which the jaw fits flush with the side surfaces.

The portable swaging tool of this invention provides operational effectiveness and convenience not attainable with tools now employed to affix replacement terminals onto battery cables. This tool is especially advantageous in such use when the battery cable is already installed in a motor vehicle. Shown in specific embodiment, this tool nevertheless may be modified, as by adding, combining, subdividing, or substituting parts, while at the same time retaining at least some of the benefits of this invention—which itself is defined in the following claims.

The claimed invention:

1. Portable tool for affixing a terminal onto an electrical storage battery cable, comprising a handle member having a holding portion for supporting the tool manually and a clamping member juxtaposable thereto, each such member carrying along an adjacent edge and intermediate the ends thereof one of a pair of cooperating swaging jaws, pivot means carried by one end of the handle member and swingably carrying the clamping member at one of its ends, the other end of the clamping member having a slot therein, clamping screw means carried by and protruding from the handle member adjacent the holding portion and adapted to engage the sloted end of the clamping member, the clamping screw means being manipulatable to force the clamping member swingably against the handle member to close the swaging jaws.

2. Tool according to claim 1, wherein the clamping screw means comprises a stud carried by the handle member and adapted to engage the slotted end of the clamping member, and a nut threaded onto the stud and adapted to engage such clamping member end.

3. Method of affixing a battery cable terminal onto a battery cable by means of the tool of claim 2, comprising holding the tool manually by the holding portion of the handle member, with the clamping member unclamped and its slotted end swung away from the handle member, inserting a pre-bored terminal between the jaws and swinging the clamping member to grip the terminal between the jaws, inserting an end of a battery cable into the terminal bore, and screwing the nut further onto the stud and thereby forcing the clamping member to the closed position and so swaging the terminal onto the cable.

4. Method of affixing a replacement battery cable terminal onto an end of a battery cable installed in a motor vehicle, comprising gripping the terminal base between cooperating swaging jaws, inserting an end of the cable into a bore in the terminal base, forcing the swaging jaws toward one another and thereby swaging the terminal onto the cable end, wherein the swaging force is applied by screwing a nut onto a threaded member interconnecting pivotally juxtaposable members carrying the swaging jaws while manually holding a handle portion adjacent the threaded member.

5. Method of affixing a replacement terminal for a battery cable, onto an end thereof having a receptive opening therein, according to claim 4, including manually holding one of the juxtaposable members and also manually holding means for screwing the nut onto the threaded member to force the swaging jaws together.

6. Method of affixing a replacement terminal for a battery calbe thereonto according to claim 5, wherein the nut is screwed onto the threaded member using a wrench.

7. Method of affixing a replacement terminal for a battery cable thereonto according to claim 5, wherein the nut is screwed onto the threaded member using rotary drive means.

8. Portable tool for affixing a replacement terminal onto a battery cable already installed in a vehicle or similarly confined space, comprising a short-handled tool having a handle member with a handle portion by which the tool is held manually in said confined space without necessity of other support while being used, a clamping member pivoted juxtaposably to the handle member, a pair of cooperating swaging jaws carried by the handle and the clamping members, respectively, and means adapted to interconnect the handle member and the clamping member adjacent said handle portion for juxtaposition to one another forcibly enough to swage the terminal therebetween and onto the end of the cable.

9. Portable tool according to claim 8, including manually actuated means for juxtaposing the handle member and the clamping member and thereby forcing the swaging jaws together.

* * * * *